United States Patent [19]

Prindle

[11] 4,224,763

[45] Sep. 30, 1980

[54] VASE, HORTICULTURAL DISPLAY AND METHOD OF PREPARING A HORTICULTURAL DISPLAY

[75] Inventor: William A. Prindle, New Martinsville, W. Va.

[73] Assignee: Viking Glass Company, New Martinsville, W. Va.

[21] Appl. No.: 26,629

[22] Filed: Apr. 2, 1979

[51] Int. Cl.[2] ..... A47G 7/07

[52] U.S. Cl. ..... 47/41.11; 47/41 R; 248/1; 248/431

[58] Field of Search ..... 47/41, 41.11, 41.13; 248/431, 1

[56] References Cited

U.S. PATENT DOCUMENTS

| | | | |
|---|---|---|---|
| 1,295,265 | 2/1919 | Bradley | 248/431 X |
| 1,477,233 | 12/1923 | Alexander | 248/431 X |
| 1,873,693 | 8/1932 | Whitfield et al. | 47/41.11 X |
| 2,247,191 | 6/1941 | Endres | 47/41 X |
| 2,691,849 | 10/1954 | Ehlers | 47/41.11 |
| 2,710,733 | 6/1955 | Phillips | 248/431 |
| 2,749,147 | 6/1956 | Herrschaft | 248/431 |
| 3,447,262 | 6/1969 | Uhl | 47/41.11 |
| 3,524,280 | 8/1970 | McKinnon | 47/41.11 |

*Primary Examiner*—Robert E. Bagwill

*Attorney, Agent, or Firm*—Beveridge, DeGrandi, Kline & Lunsford

[57] ABSTRACT

Horticultural items are displayed in a vase which includes a base for supporting the lower ends of stems of the items at locations spaced from the vertical axis of the vase assembly, and a retainer ring supported exclusively on the stems for holding the stems together in intersecting relationship in an area which is substantially smaller than the area of the base and is spaced above the base and substantially centered on the central axis of the vase assembly. The lower portions of the stems converge upwardly to form a tripod made of stems which support each other and the retainer, with the upper portions of the stems diverging upwardly away from the retainer. A display of horticultural items is prepared by binding the items together by placing a ring around the stems, inclining the stems relatively to each other so the stems diverge from each other in directions leading away from the ring, and inserting the lower ends of the stems in a vessel which prevents the splaying of their lower ends.

8 Claims, 1 Drawing Figure

VASE, HORTICULTURAL DISPLAY AND METHOD OF PREPARING A HORTICULTURAL DISPLAY

BACKGROUND OF THE INVENTION

The present invention relates to a vase and to a method for making a display of horticultural items such as cut flowers or greenery.

Various types of vessels have been used to display horticultural items such as flowers to achieve pleasing, decorative effects. Indeed flower vases as a general matter have probably been known since prehistoric times. Other than providing a decorative appearance, a suitable flower vase should provide a basin for holding water or nutrients needed to maintain the flowers in an attractive condition and support their stems at a generally upstanding orientation. Nearly all of the conventional devices known to the inventor have achieved this support function by means of physical support elements other than the flowers to be supported. In other words, these devices have supported the flowers with the neck of the vase or an independent support element which is not a flower itself. Examples of such devices are shown in Schmidt German Pat. No. 478,221; Davidson British Pat. No. 344,022; Cheesewright U.S. Pat. No. 1,860,405; and Osterlund U.S. Pat. No. 2,050,893. Pearson U.S. Pat. No. 3,778,929 discloses a structure which prevents flowers from drooping by means of a collar which maintains the tops of the flowers within the periphery of the pot edge. In the Pearson structure, embedded roots retain the lower ends of the flower stems, and the adjacent stems are not connected to provide mutual support.

SUMMARY OF THE INVENTION

According to the present invention, a vase assembly for displaying stemmed horticultural items includes a base for supporting the lower ends of stems at locations spaced from the vertical central axis of the vase assembly, and a retainer supportable exclusively on the stems for holding the stems together in intersecting relationship. The retainer holds the stems together in an area which is centered above the base and is substantially smaller than the area of the base. The lower portions of the stems converge upwardly to form a tripod made of stems which support each other and the retainer. The upper portions of the stems diverge upwardly away from the retainer. The present invention also includes the method of displaying horticultural items, including the steps of binding the stems together by placing a ring around the stems at their medians, inclining the stems relative to each other so that the stems diverge from each other in directions leading away from the ring, and inserting the lower ends of the stems into a vessel which prevents them from splaying.

BRIEF DESCRIPTION OF THE DRAWING

The drawing shows a typical flower arrangement employing the apparatus of a preferred embodiment of the present invention, along with interchangeable accessory elements of the apparatus.

DESCRIPTION OF A PREFERRED EMBODIMENT

Figure 1:
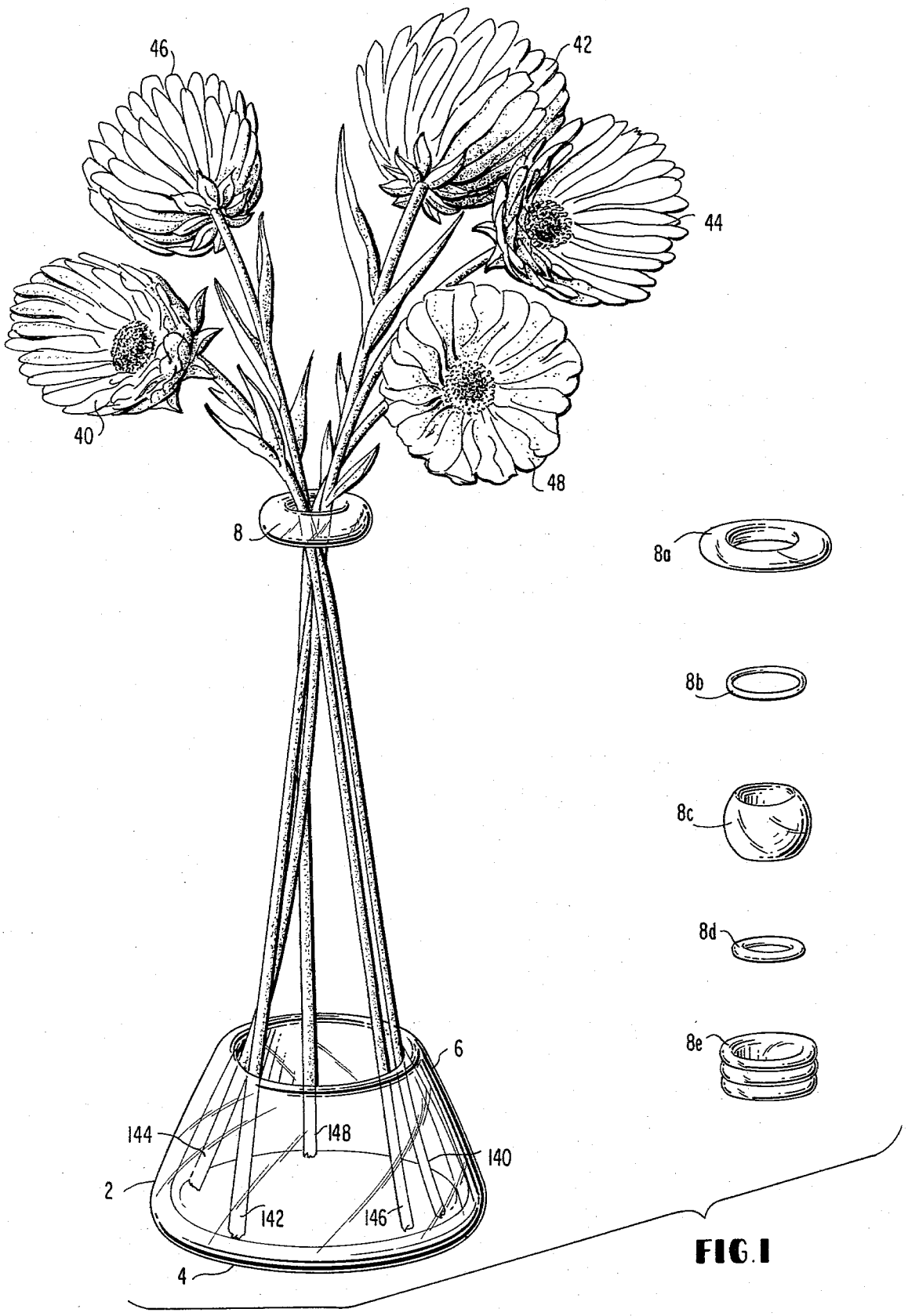

As shown in the drawings, the apparatus includes a vessel 2 and a retainer ring 8 which cooperate to support the stems of a group of flowers 40, 42, 44, 46 and 48. The stems 140, 142, 144, 146 and 148 converge upwardly to an area of intersection within the ring 8, and they diverge upwardly above the ring 8 as shown.

The vessel 2 provides a base for supporting the lower ends of the stems. It includes a bottom wall 4 and a frustoconical sidewall 6 inclined upwardly and inwardly toward the vertical central axis of the device. The height of sidewall 6 is preferably less than one-half the maximum internal dimension of the vessel 2. The vessel 2 holds the lower ends of the stems in spaced relationship to the central axis of the apparatus, and sidewall 6 prevents the splaying of the stems beyond a desired limit. The sidewall 6 may be at a right angle to the bottom wall 4, or it may have other configurations. Preferably it is inwardly inclined as illustrated. Vessel 2 may be formed from a wide variety of materials, preferably those which can retain water without being deteriorated, such materials including glass, wood, metal, ceramics and plastics.

The retainer ring 8, preferably made of a material which is the same as or complementary to the vessel 2, is floating in the sense that it is supported only by the flower stems 140, 142, 144, 146 and 148. Ring 8 holds the stems together in an area which is smaller than the vessel 2 and is centrally located above the vessel 2. Its horizontal internal diameter is no greater than about one-fourth the maximum horizontal inside diameter of the vessel 2. The ring 8 may be sold with a set of interchangeable rings 8*a*, 8*b*, 8*c*, 8*d* and 8*e* of various sizes, shapes, weights and colors. Providing different sizes and weights of rings enables the user to select a ring which is physically capable of holding the stems together while being supported thereby. The rings may also be selected on the basis of their appearance to provide visual compatibility with the vessel 2 and the horticultural items displayed in the apparatus. Ring 8*b* is sufficiently thin to render it substantially invisible.

To prepare a display of flowers or other horticultural stems, three or more stems are held generally parallel with the cut lower ends thereof laterally aligned with each other. The stems are inserted, cut end first, through one of the retainer rings 8, 8*a*, 8*b*, 8*c*, 8*d* or 8*e* until the ring is substantially at the longitudinal midportion of the flowers. The stems may be inserted one at a time through the ring if desired. The size and number of stems should be such that the ring will frictionally contact them without damaging them. This, of course, may require the selection of a retainer ring which has an appropriate internal diameter for the items to be displayed.

When all stems are in the ring 8, the ends of the stems are moved apart radially to an orientation where they are inclined relative to each other, diverging from each other in directions leading away from the ring. The lower ends of the stems are then inserted in the vessel 2, the sidewall 6 of which prevent splaying of the stems. Three or more stems are distributed, preferably at equal circumferential spacings, to form a tripod which supports the flowers and the retainer ring. The tops of the flowers may be arranged into a desired grouping if care is taken not to disturb the relative positioning of the lower ends of the stems. The ring 8 when finally positioned should be substantially centered on the vertical central axis of the vessel 2. Water may be added to the vessel 2 to prolong the life of the floral display.

Those skilled in the art will appreciate that many modifications of the invention may be made without departing from its spirit and scope. This description has been full and complete, including a description of the best mode, and is to be in no way limitative of the scope of patent protection afforded.

I claim:

1. A vase assembly for holding the elongated stems of a group of horticultural items in generally upstanding orientation, said vase assembly having a vertical central axis and comprising a base having means for supporting the lower ends of stems and holding said lower ends at locations which are spaced from the central axis, a retainer means supportable exclusively on the stems for holding the stems together in intersecting relationship in an area which is substantially smaller than said base and is spaced above said base and centered on said central axis, whereby lower portions of said stems converge upwardly toward said retainer means to form a stable structure of stems for supporting each other and the retainer means, with the upper portions of said stems diverging upwardly away from said retainer means.

2. A vase assembly according to claim 1 wherein the retainer means is a closed ring.

3. A vase assembly according to claim 1 wherein the base is a water-holding vessel having a bottom and a frustoconical sidewall extending upwardly from said bottom.

4. A vase assembly according to claim 1 having a set of at least two interchangeable retainer means in the form of rings provided with openings of different sizes.

5. A vase assembly according to claim 1 wherein the base has a height which is less than one-half its maximum internal horizontal dimension, and the retaining means has a stem-receiving opening which is less than one-fourth the maximum internal horizontal dimension of the base.

6. A horticultural display comprising a base, a plurality of horticultural items supported on said base and having elongated stems which have lower portions converging toward each other and toward a given area which is substantially smaller than the base and is centrally located relative to the base at a given elevation above the base, retainer means supported only by said stems for holding said stems in said given area at said given elevation, said stems having upper portions diverging upwardly above said retainer means.

7. The horticultural display of claim 6 wherein the distance across said given area is less than one-fourth of the maximum horizontal dimension of the base.

8. A method of preparing a display of horticultural items which have elongated stems, comprising the steps of (a) binding said stems together by placing them in a ring located intermediate the opposite ends of the stems, (b) inclining said stems relative to each other so said stems diverge from each other in directions leading away from said ring, and (c) inserting the lower ends of said stems into a vessel which prevents the splaying of said lower ends.

* * * * *